US006229530B1

(12) United States Patent
Ushiki

(10) Patent No.: US 6,229,530 B1
(45) Date of Patent: May 8, 2001

(54) LIQUID CRYSTAL DRIVING CIRCUIT

(75) Inventor: Hiroshi Ushiki, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/248,315

(22) Filed: Feb. 11, 1999

(30) Foreign Application Priority Data

Feb. 12, 1998 (JP) ..... 10-030108

(51) Int. Cl.[7] ..... G09G 3/36
(52) U.S. Cl. ..... 345/204; 345/94
(58) Field of Search ..... 345/204, 94

(56) References Cited

U.S. PATENT DOCUMENTS 5,130,703 * 7/1992 Fairbanks et al. ..... 345/94
5,136,458 * 8/1992 Durivage, III ..... 361/93.2

FOREIGN PATENT DOCUMENTS 9-197366 7/1997 (JP) .

* cited by examiner

*Primary Examiner*—Bipin Shalwala
*Assistant Examiner*—Vincent E. Kovalick
(74) *Attorney, Agent, or Firm*—Oblon, Spivak, McClelland, Maier & Neustadt, P.C.

(57) ABSTRACT

There is provided a low power consumption liquid crystal driving circuit which is able to achieve reduction in the power consumption. In this liquid crystal driving circuit, first charges are supplied to a charge pump capacitor 11 by connecting one end of the capacitor 11 to an output of a first regulator and other end of the capacitor 11 to an output of the second regulator. Then, the capacitor 11 can be connected in parallel with any one of charge storage capacitors 12 to 15 by controlling ON/OFF of analogue switches 16 to 25 based on the time division signals ϕ A to ϕ E. Then, charges in the capacitor 11 are supplied to the selected charge storage capacitor to generate a liquid crystal driving intermediate potential.

6 Claims, 10 Drawing Sheets

LIQUID CRYSTAL DRIVING CIRCUIT

BACKGROUND OF THE INVENTION

1. Field of the Invention

The present invention a driving circuit for a liquid crystal device. More particularly, the present invention relates to a liquid crystal driving circuit for driving a liquid crystal display screen in a personal digital assistant, etc.

2. Description of the Related Art

As a display means of a personal digital assistant such as a pager, a cellular phone, an electronic pocketbook, etc., a low power consumption liquid crystal element is employed. As a liquid crystal element driving system, there is a low power consumption driving system which employs a voltage step up/down circuit using capacitors and which is mainly employed in low duty display such as numerals, alphabets, etc. In contrast, there is employed a driving system which employs an operational amplifier and which is employed in high duty display such as Chinese characters, characters, etc. In this system, a large power is consumed because a large current flows through the operational amplifier. Today a larger display screen of the liquid crystal display, i.e., higher duty of the liquid crystal has been advanced with the progress of multi-function of the personal digital assistant. It is certain that such high duty display will become the mainstream of the liquid crystal display in the near future. Therefore, the low power consumption liquid crystal driving circuit is also earnestly desired in the field of the high duty display.

A liquid crystal driving circuit to enable the high duty display in the prior art will be explained hereunder. FIG. 1 is a circuit diagram showing a configuration of the liquid crystal driving circuit employed for the high duty display in the prior art. In this liquid crystal driving circuit, voltage dividing resistors 103 to 105, one of bias selection resistors 106 to 109, and voltage dividing resistors 110 and 111 are connected in series between the supply voltage Vdd 101 for generating the liquid power supply and the reference voltage Vss 102. Thus, intermediate potentials can be generated according to respective resistance values of the bias selection resistors 106 to 109. The voltage dividing resistor 103 is a liquid crystal temperature compensating resistor whose resistance value RA can be varied by the software control.

In general, a proper value of a liquid crystal bias voltage VC1 in the liquid crystal using the TN (Twisted Nematic) method or the STN (Super Twisted Nematic) method can be given by $$VC1=1/((\text{duty})^{1/2}-1) \text{ to } 1/((\text{duty})^{1/2})+1 \quad (1)$$

This liquid crystal bias voltage VC1 can be decided by selecting any one of the bias selection resistors 106 to 109. This selection of the bias selection resistors 106 to 109 is made by decoding 2-bit signals R1, R2 by using a decoder 112 in the publicly known technology and then turning ON any one of analogue switches 113 to 116 selectively based on an output signal of the decoder 112.

Normally the voltage dividing resistors 104, 105, 110, 111 are set to have the same resistance value and the resistance values of the bias selection resistors 106 to 109 are set N times larger than that of the voltage dividing resistors 104, 105, 110, 111. Usually, 2 to 5 is used as the value N. For example, in case the resistance value of the voltage dividing resistors 104, 105, 110, 111 is assumed as RB, the resistance value of the bias selection resistor 109 is selected as 2RB, the resistance value of the bias selection resistor 108 is selected as 3RB, the resistance value of the bias selection resistor 107 is selected as 4RB, and the resistance value of the bias selection resistor 106 is selected as 5RB. Accordingly, the liquid crystal bias voltage VC1 becomes ⅙ bias if the bias selection resistor 109 is selected, the liquid crystal bias voltage VC1 becomes ⅐ bias if the bias selection resistor 108 is selected, the liquid crystal bias voltage VC1 becomes ⅛ bias if the bias selection resistor 107 is selected, and the liquid crystal bias voltage VC1 becomes ⅑ bias if the bias selection resistor 106 is selected.

In this liquid crystal driving circuit, the resistors 103 to 111 are set to have high resistance such that the direct current flowing through them should be suppressed as small as possible. The intermediate potentials generated by using the resistors 103 to 111 are amplified by operational amplifiers 117 to 121. As a result, sufficient current to drive the large size liquid crystal display screen can be generated. Thus, outputs of the operational amplifiers 117 to 121 are stored in the capacitors 122 to 126 to be stabilized.

FIG. 2 is a view showing behaviors of driving waveforms of a common bias voltage COM and a segment bias voltage SEG when the analogue switch 116 in FIG. 1 is turned ON to select the resistor 109 and thus to set the liquid crystal bias voltage VC1 to ⅙ bias. In FIG. 2, the liquid crystal element is brought into its energized state only in a period of time when potential difference between the segment bias voltage SEG and the common bias voltage COM is within ±VLC, and it is brought into its non-energized state in other periods of time. As shown in FIG. 3, the COM-based SEG becomes ±VLC in the energized state and becomes VLC3−VLC4 (=+VLC/6) or VLC2−VLC1 (=−VLC/6) in the non-energized state.

However, in the liquid crystal driving circuit in the prior art shown in FIG. 1, the direct current always flows through the resistors 103 to 111 and also the large current is consumed in the operational amplifiers 117 to 121 which are employed to amplify the generated intermediate potential. Since these currents always flow during the display operation, such currents have caused a serious problem to achieve lower power consumption of the personal digital assistant, etc.

SUMMARY OF THE INVENTION

The present invention has been made to overcome the above-mentioned problem in the prior art, and it is an object of the present invention to provide a low power consumption liquid crystal driving circuit for driving a liquid crystal device which enables high duty display.

In order to achieve the above object, according to a feature of the present invention, there is provided a liquid crystal driving circuit comprising a first capacitor, a plurality of external terminals, a plurality of second capacitors connected between the plurality of external terminals, a first regulator connected between a first power supply and a second power supply, a second regulator connected between an output of the first regulator and the second power supply, a circuit for generating a plurality of time division signals, and a switching means for connecting outputs of the first regulator and the second regulator to the first capacitor, or connecting the first capacitor to any one of the second capacitors, based on the time division signals.

In the feature of the present invention, preferably the first power supply may be a power supply which supplies a liquid crystal power supply generating voltage, and the second power supply may be a power supply which supplies a reference voltage. The reference voltage may be a ground voltage. The switching means may be composed of a plurality of analogue switches. This is because the switching means can execute switching of connection to either of the first capacitor and the second capacitor by using a simple circuit. The plurality of second capacitors may be composed of a plurality of third capacitors which are connected between the first power supply and the plurality of external terminals, and a plurality of fourth capacitors which are connected between the plurality of external terminals and the second power supply. This is because respective intermediate potentials being generated can be stored without fail.

According to the feature of the present invention, the low power consumption liquid crystal driving circuit can be provided wherein a plurality of liquid crystal driving intermediate potentials can be generated by applying the liquid crystal bias voltage VC1, which is difference in outputs between the first regulator and the second regulator, to both ends of the first capacitor to thus supply the charges to the first capacitor, then controlling ON/OFFs of respective analogue switches based on the time division signals to thus connect the first capacitor in parallel with any one of the plurality of second capacitors, and then supplying the charges in the first capacitor to the second selected capacitor.

Other and further objects and features of the present invention will become obvious upon an understanding of the illustrative embodiment about to be described in connection with the accompanying drawings or will be indicated in the appended claims, and various advantages not referred to herein will occur to one skilled in the art upon employing of the invention in practice.

DESCRIPTION OF THE PREFERRED EMBODIMENTS

Figure 1:
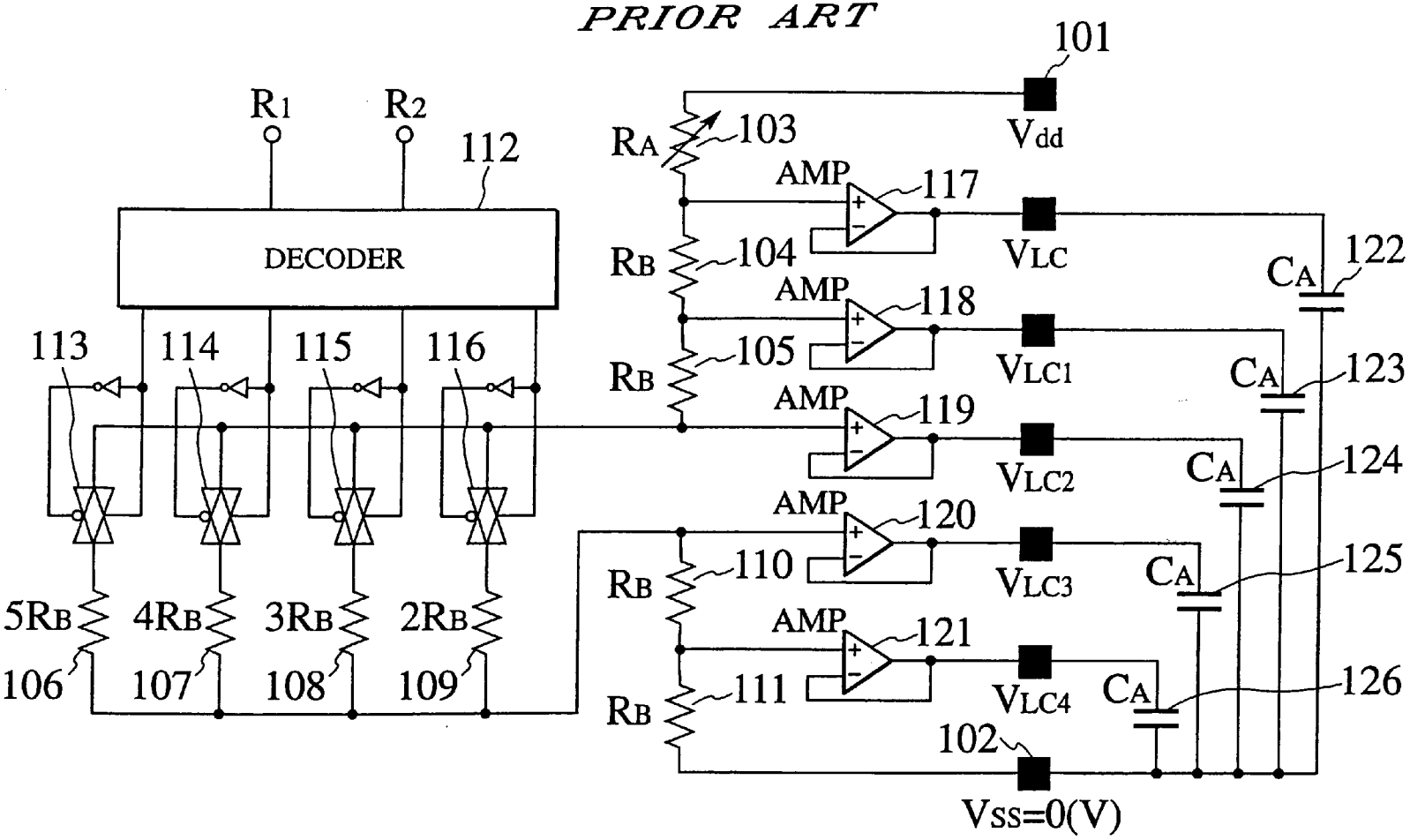
FIG. 1 PRIOR ART
FIG. 1 is a circuit diagram showing a configuration of a liquid crystal driving circuit in the prior art.
Figure 2:
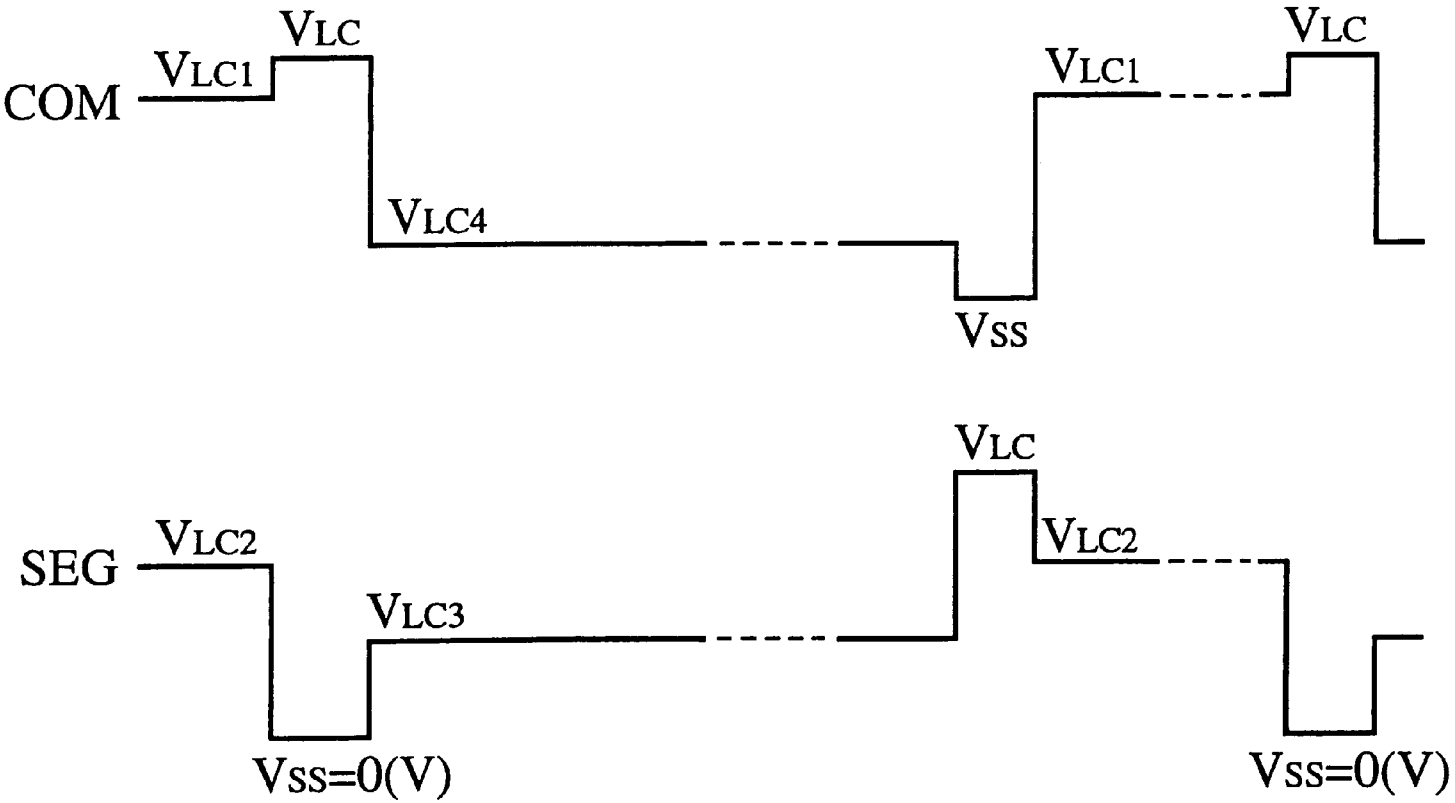
FIG. 2 PRIOR ART
FIG. 2 is a view showing behaviors of driving waveforms of a common bias voltage COM and a segment bias voltage SEG when an analogue switch 116 in FIG. 1 is turned ON to select a resistor 109 and thus to set a liquid crystal bias voltage VC1 to ⅙ bias.
Figure 3:
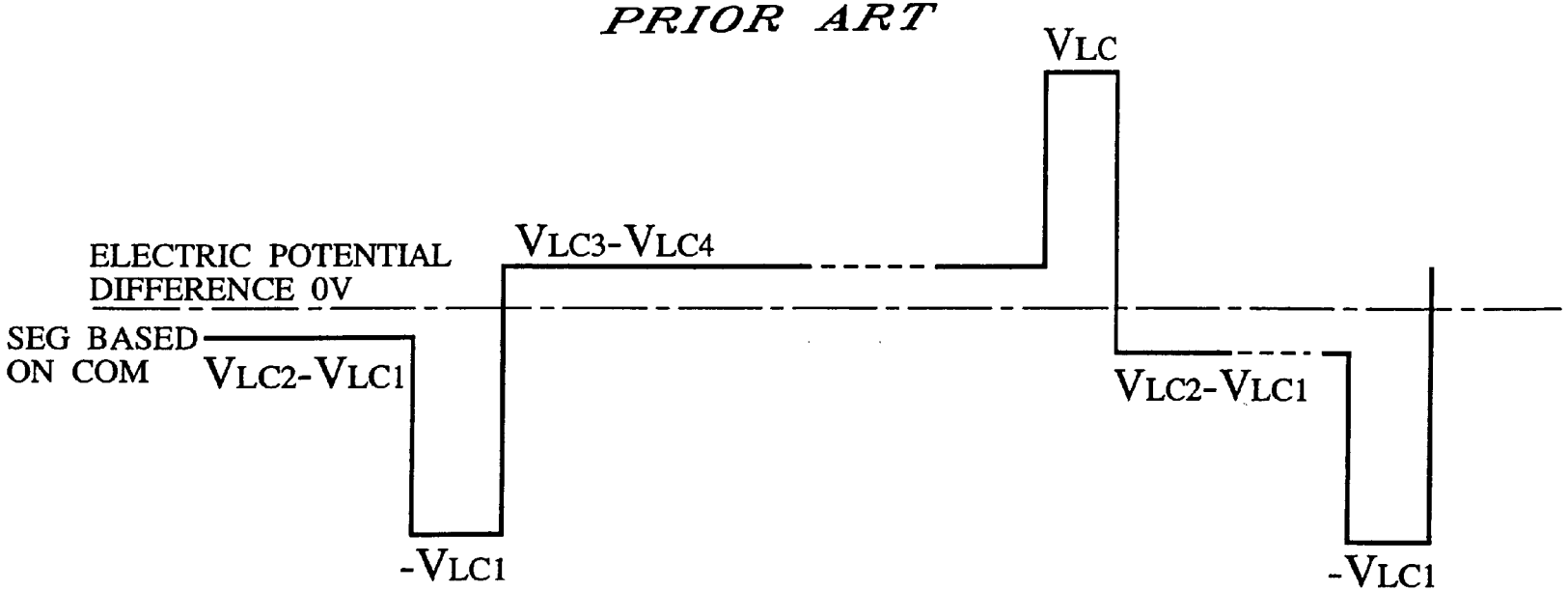
FIG. 3 PRIOR ART
FIG. 3 is a view showing potential difference between the common bias voltage COM and the segment bias voltage SEG in FIG. 2.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Figure 4:
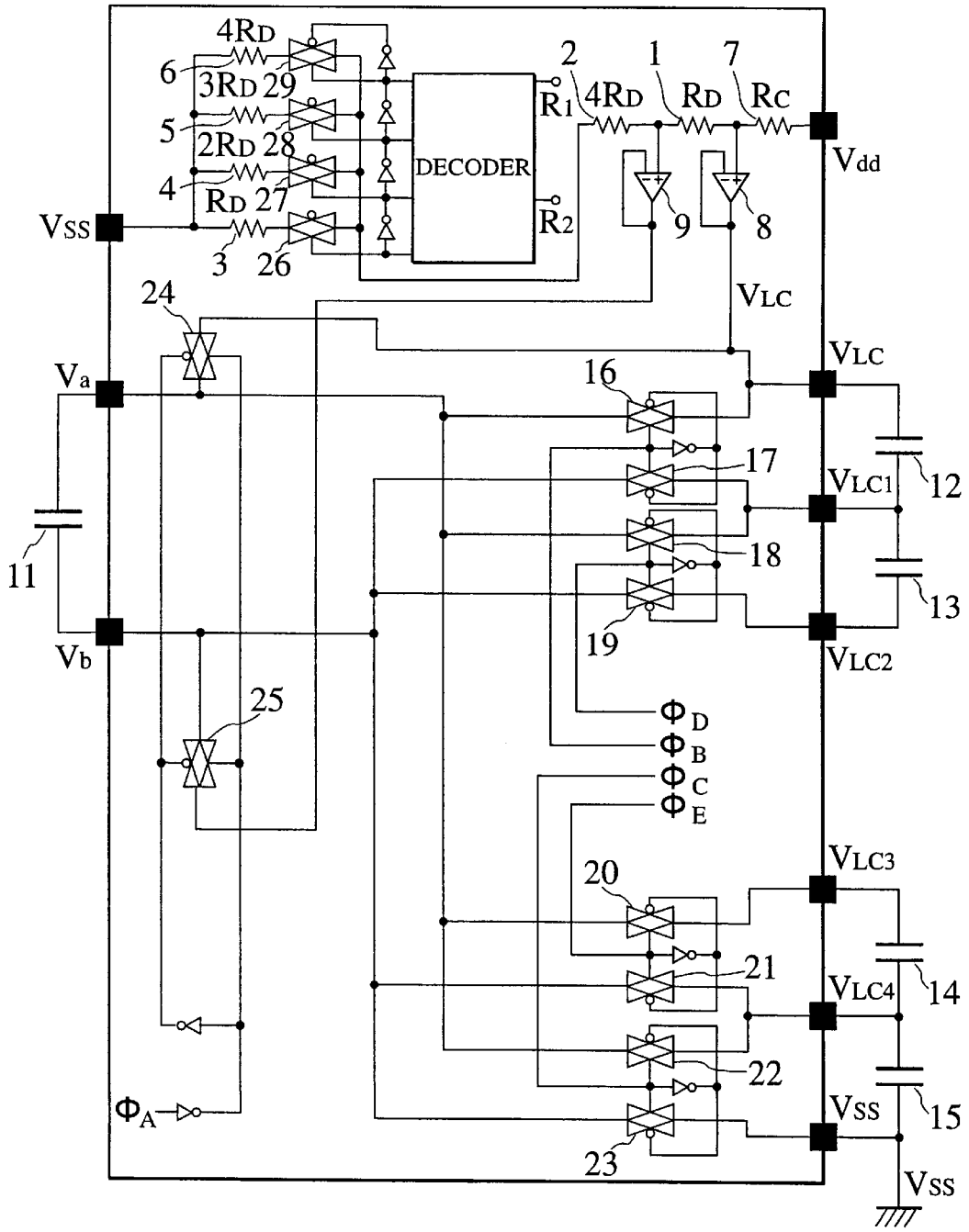
FIG. 4 is a circuit diagram showing a configuration of a liquid crystal driving circuit according to the related art of the present invention.

First, the related art of the present invention will be explained. FIG. 4 shows a configuration of a liquid crystal driving circuit according to the related art of the present invention. As shown in FIG. 4, in the liquid crystal driving circuit according to the related art of the present invention, any one of analogue switches 26 to 29 is turned ON according to an output signal of a decoder 10 to select any one of bias selection resistors 3 to 6, thereby setting a desired liquid crystal bias voltage VC1. Then, the liquid crystal bias voltage VC1 is applied across a charge pump capacitor 11 to supply charges to the capacitor 11. ON/OFF operations of analogue switches 16 to 25 are controlled based on time division signals ϕ A to ϕ E respectively, so that the charge pump capacitor 11 is connected in parallel with any one of charge storage capacitors 12 to 15 selectively to supply the charges to them, thereby generating intermediate potentials VLC1 to VLC4. Since the charge pump system which uses a voltage step up/down circuit formed of a plurality of capacitors is employed in this liquid crystal driving circuit, the power consumption can be reduced significantly rather than the liquid crystal driving circuit in the prior art shown in FIG. 1.

Figure 5:
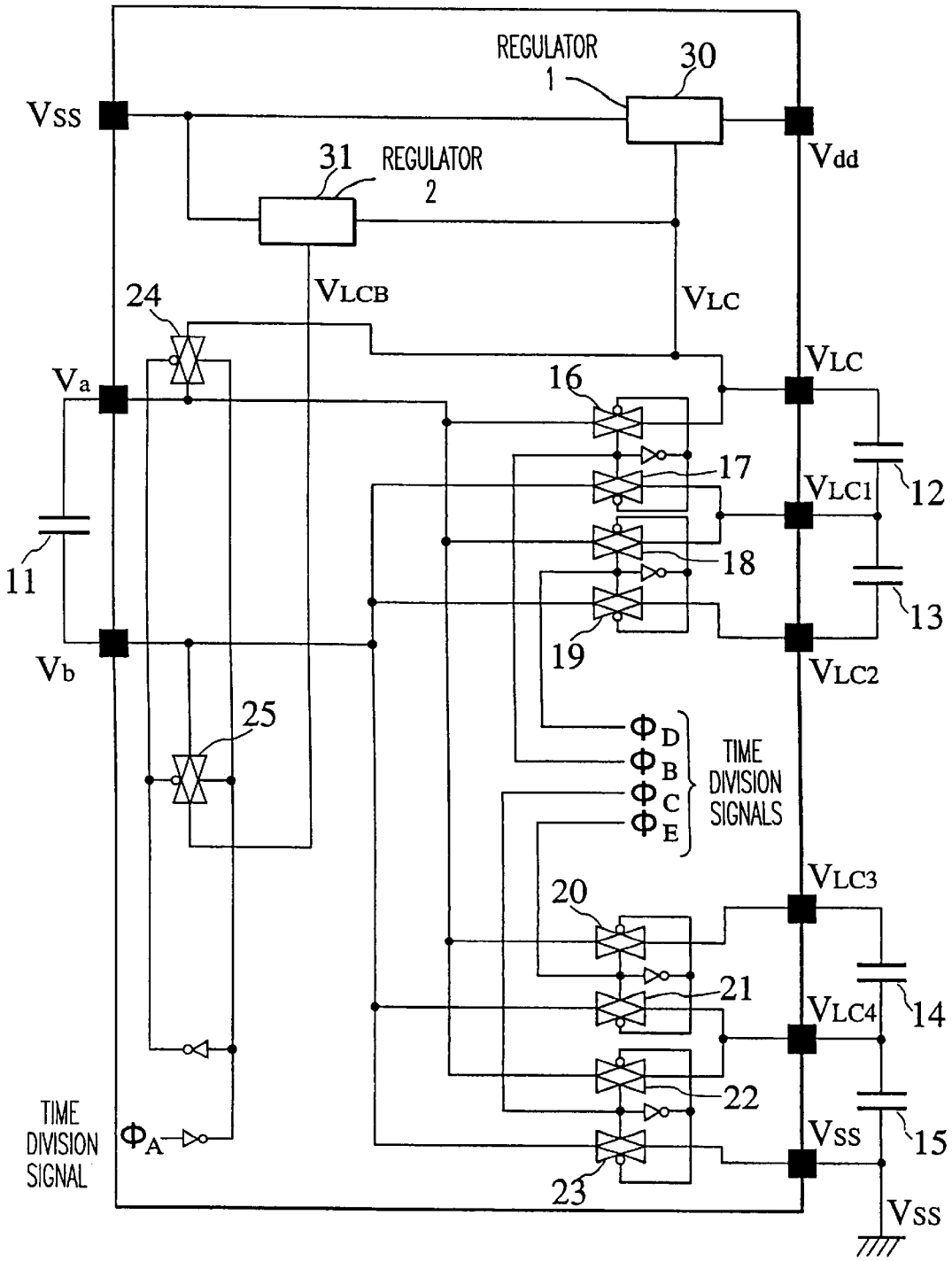
FIG. 5 is a circuit diagram showing a configuration of a liquid crystal driving circuit according to an embodiment of the present invention.

Next, an embodiment of the present invention will be explained with reference to the drawings hereinbelow. FIG. 5 is a circuit diagram showing a configuration of a liquid crystal driving circuit according to the embodiment of the present invention. In the embodiment of the present invention, the power consumption can be reduced by eliminating the resistors 1 to 7 and operational amplifiers 8, 9 in the liquid crystal driving circuit according to the related art shown in FIG. 4, so that reduction in the power consumption can be achieved much more. As shown in FIG. 5, in the liquid crystal driving circuit according to the embodiment of the present invention, a first regulator 30 connected between a power supply voltage Vdd for generating a liquid crystal power supply and a reference voltage Vss, and a second regulator 31 connected between a liquid crystal driving voltage VLC and the reference voltage Vss are provided. The first regulator 30 generates the liquid crystal driving voltage VLC from the power supply voltage Vdd and the reference voltage Vss. The first regulator 30 has a temperature compensating function for compensating a temperature of the liquid crystal. Such temperature compensating function can be implemented by changing an output voltage of the first regulator 30 by virtue of software control, for example. The second regulator 31 generates a bias generating voltage VLCB from the liquid crystal driving voltage VLC and the reference voltage Vss. A liquid crystal bias voltage VC1 is represented by potential difference between the liquid crystal driving voltage VLC and the bias generating voltage VLCB. Circuits of the first regulator 30 and the second regulator 31 are constructed such that bias selection of the liquid crystal bias voltage VC1 can be set to VC1=VLC−VLCB=VLC/N. The second regulator 30 can change the value N by the software control. Any low power consumption type regulator may be employed as the first regulator 30 and the second regulator 31, and thus it is possible to adopt various circuit configurations.

Figure 6:
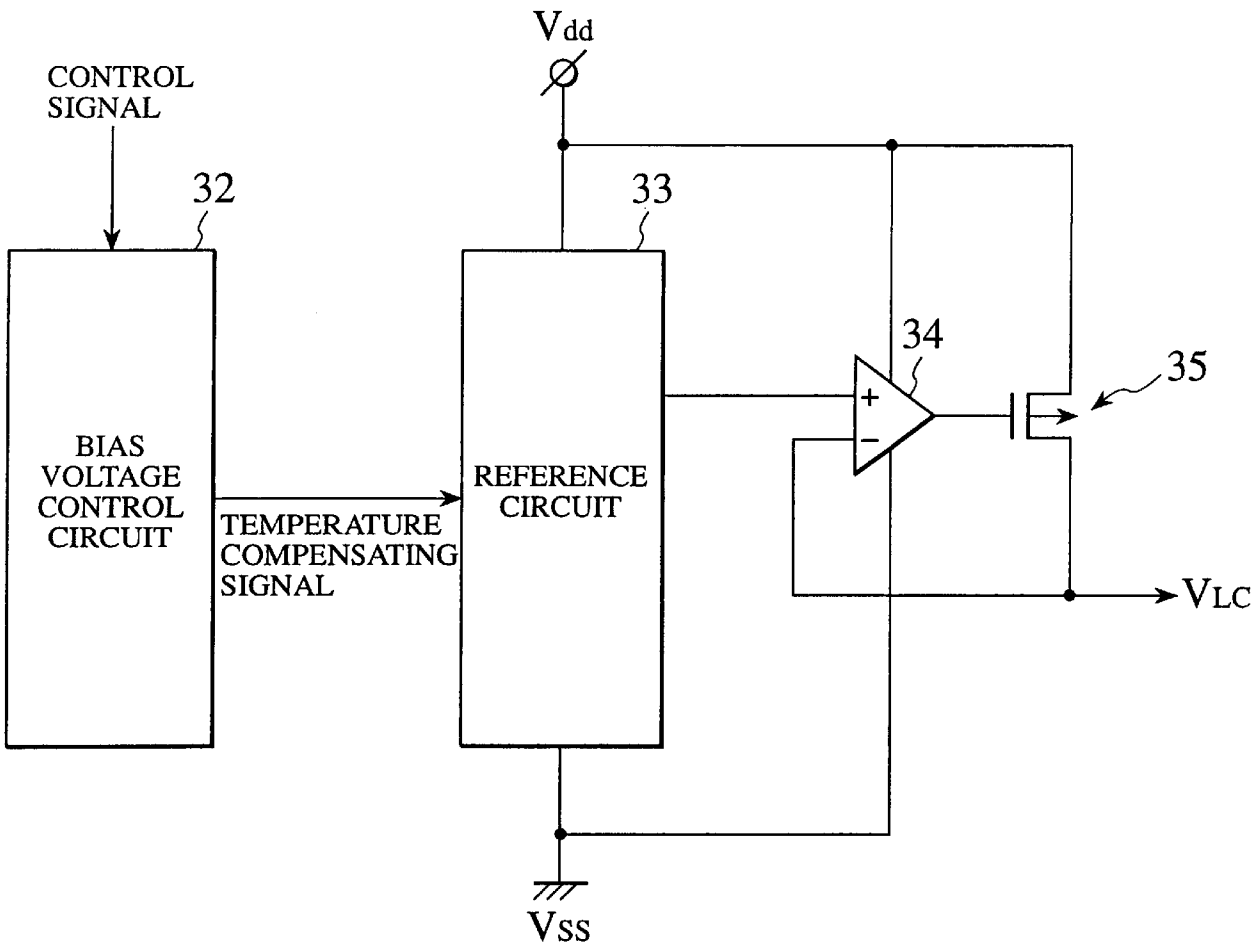
FIG. 6 is a block circuit diagram showing an example of a configuration of a first regulator 30 in FIG. 5.
Figure 7:
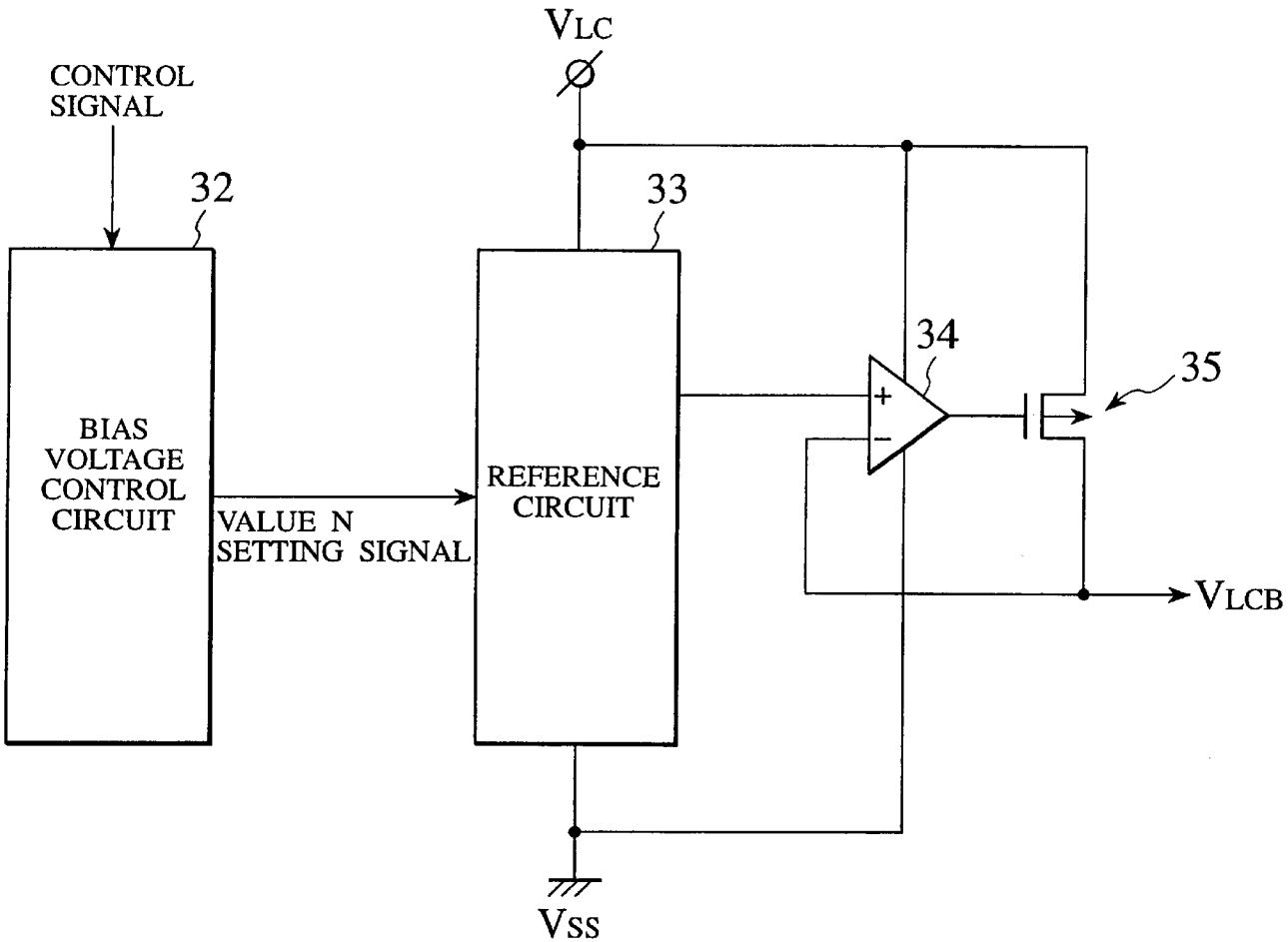
FIG. 7 is a block circuit diagram showing an example of a configuration of a second regulator 31 in FIG. 5.

FIG. 6 is a view showing an example of a configuration of the first regulator 30 in FIG. 5. FIG. 7 is a view showing an example of a configuration of the second regulator 31 in FIG. 5. As shown in FIGS. 6 and 7, each of the first regulator 30 and the second regulator 31 comprises a bias voltage control circuit 32, a reference circuit 33, a differential amplifier 34, and an output circuit 35. In the first regulator 30, the bias voltage control circuit 32 receives a control signal from a microcomputer (not shown) and then outputs a temperature compensating signal to the reference circuit 32. In the second regulator 31, the bias voltage control circuit 32 receives the control signal from the microcomputer (not shown) and then outputs a value N setting signal to the reference circuit 33. For example, in the case of N=6 to 9, a 3-bit signal may be employed as the value N setting signal.

Returning to FIG. 5, in the liquid crystal driving circuit according to the embodiment of the present invention, an output of the first regulator 30 is connected to a terminal Va via an analogue switch 24. An output of the second regulator 31 is connected to a terminal Vb via an analogue switch 25. The charge pump capacitor 11 is then connected between the terminal Va and the terminal Vb. The terminal Va is connected to terminals VLC, VLC1, VLC3, VLC4 via the analogue switches 16, 18, 20, 22 respectively. The terminal Vb is connected to terminals VLC1, VLC2, VLC4, Vss via the analogue switches 17, 19, 21, 23 respectively. A charge storage capacitor 12 is connected between the terminal VLC and the terminal VLC1, a charge storage capacitor 13 is connected between the terminal VLC1 and the terminal VLC2, a charge storage capacitor 14 is connected between the terminal VLC3 and the terminal VLC4, and a charge storage capacitor 15 is connected between the terminal VLC4 and the terminal Vss. When the analogue switches 16 to 25 receive the time division signals ϕ A to ϕ E, they decide their own ON/OFF states based on such signals.

Figure 8:
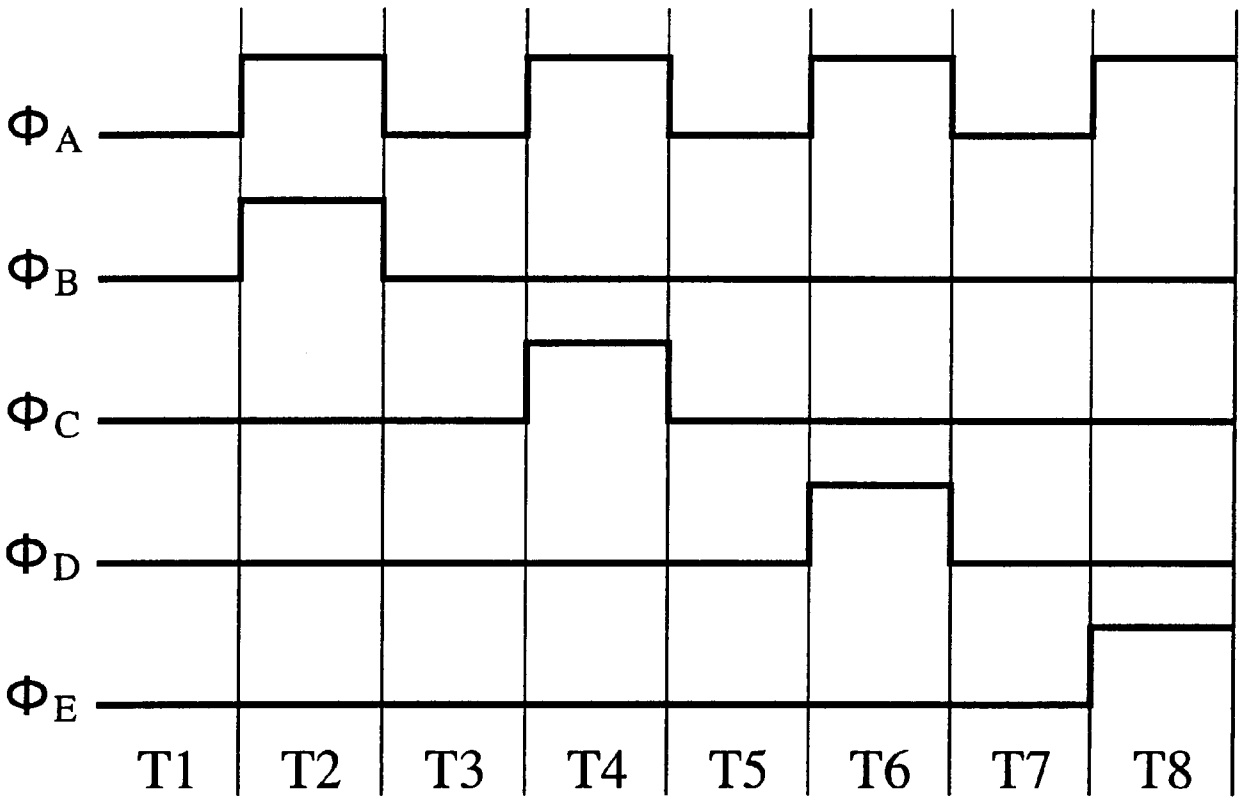
FIG. 8 is a timing chart of time division signals ϕ A to ϕ E in FIG. 5.
Figure 9:
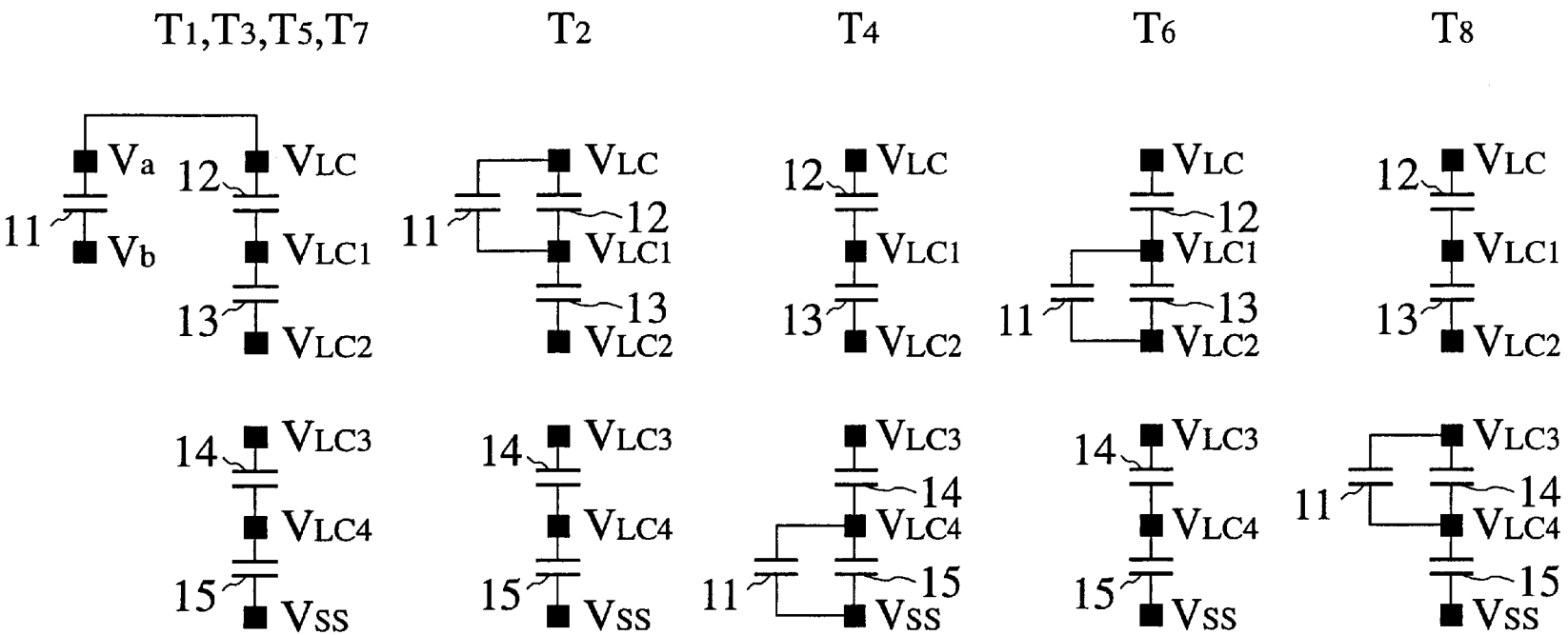
FIG. 9 is a view showing states in which both ends of a charge pump capacitor 11 in FIG. 5 are connected a terminal VLC, a terminal VLC1, a terminal VLC2, a terminal VLC3, and a terminal VLC4 based on the time division signals ϕ A to ϕ E shown in FIG. 8.

Next, an operation of the embodiment of the present invention will be explained hereunder. In this disclosure, explanation will be made by taking as an example the case where the liquid crystal bias voltage VC1 is set as VC1=VLC/N and N=6, i.e., VC1 is ⅙ bias. FIG. 8 is a timing chart of the time division signals ϕ A to ϕ E in FIG. 5. The liquid crystal driving circuit according to the embodiment of the present invention performs time division control of ON/OFF of the analogue switches 16 to 25 at timings T1 to T8 based on the time division signals ϕ A to ϕ E in FIG. 8. The time division signals ϕ A to ϕ E can be generated by logic circuits in the publicly known technology. FIG. 9 is a view showing states in which both ends of the charge pump capacitor 11 in FIG. 5 are connected the terminal VLC, the terminal VLC1, the terminal VLC2, the terminal VLC3, and the terminal VLC4 based on the time division signals ϕ A to ϕ E shown in FIG. 8.

At timings T1, T3, T5, T7 (ϕ A=0) in FIG. 8, the analogue switches 24, 25 are turned ON. Thus, the output of the first regulator 30 is connected to the terminal Va, and the output of the second regulator 31 is connected to the terminal Vb. Therefore, the liquid crystal bias voltage VC1=VLC−VLCB=VLC/6 is charged across the terminal Va and the terminal Vb, i.e., into the charge pump capacitor 11. In contrast, all the analogue switches 16 to 23 which are connected to both terminals of the charge storage capacitors 12 to 15 selectively are turned OFF. Therefore, no charge is supplied from the charge pump capacitor 11 to all the charge storage capacitors 12 to 15. At the timing T2 (ϕ B=1), the analogue switches 24, 25 are turned OFF but the analogue switches 16, 17 which are connected between the terminal VLC and the terminal VLC1 are turned ON. Therefore, the charge storage capacitor 12 is connected in parallel with the charge pump capacitor 11 and then the charges are supplied from the charge pump capacitor 11 to the charge storage capacitor 12. At the timing T4 (ϕ C=1), the analogue switches 24, 25 are turned OFF but the analogue switches 22, 23 which are connected between the terminal VLC4 and the terminal Vss are turned ON. Therefore, the charge storage capacitor 15 is connected in parallel with the charge pump capacitor 11 and then the charges are supplied from the charge pump capacitor 11 to the charge storage capacitor 15. At the timing T6 (ϕ D=1), the analogue switches 24, 25 are turned OFF but the analogue switches 18, 19 which are connected between the terminal VLC1 and the terminal VLC2 are turned ON. Therefore, the charge storage capacitor 13 is connected in parallel with the charge pump capacitor 11 and then the charges are supplied from the charge pump capacitor 11 to the charge storage capacitor 13. At the timing T8 (ϕ E=1), the analogue switches 24, 25 are turned OFF but the analogue switches 20, 21 which are connected between the terminal VLC3 and the terminal VLC4 are turned ON. Therefore, the charge storage capacitor 14 is connected in parallel with the charge pump capacitor 11 and then the charges are supplied from the charge pump capacitor 11 to the charge storage capacitor 14.

In this manner, potentials of the terminals VLC1 to VLC4 can be set as given in the following, and thus liquid crystal driving intermediate potentials are generated.

$$VLC4=VLC/6 \tag{2}$$

$$VLC3=VLC/3 \tag{3}$$

$$VLC2=2\cdot VLC/3 \tag{4}$$

$$VLC1=5\cdot VLC/6 \tag{5}$$

Accordingly, if a duty is set to N, potentials of the terminals VLC1 to VLC4 can be given as follows.

$$VLC4=VLC/N \tag{6}$$

$$VLC3=2\cdot VLC/N \tag{7}$$

$$VLC2=VLC\cdot(1-(2/N))=VLC\cdot(N-2)/N \tag{8}$$

$$VLC1=VLC\cdot(1-(1/N))=VLC\cdot(N-1)/N \tag{9}$$

Figure 10:
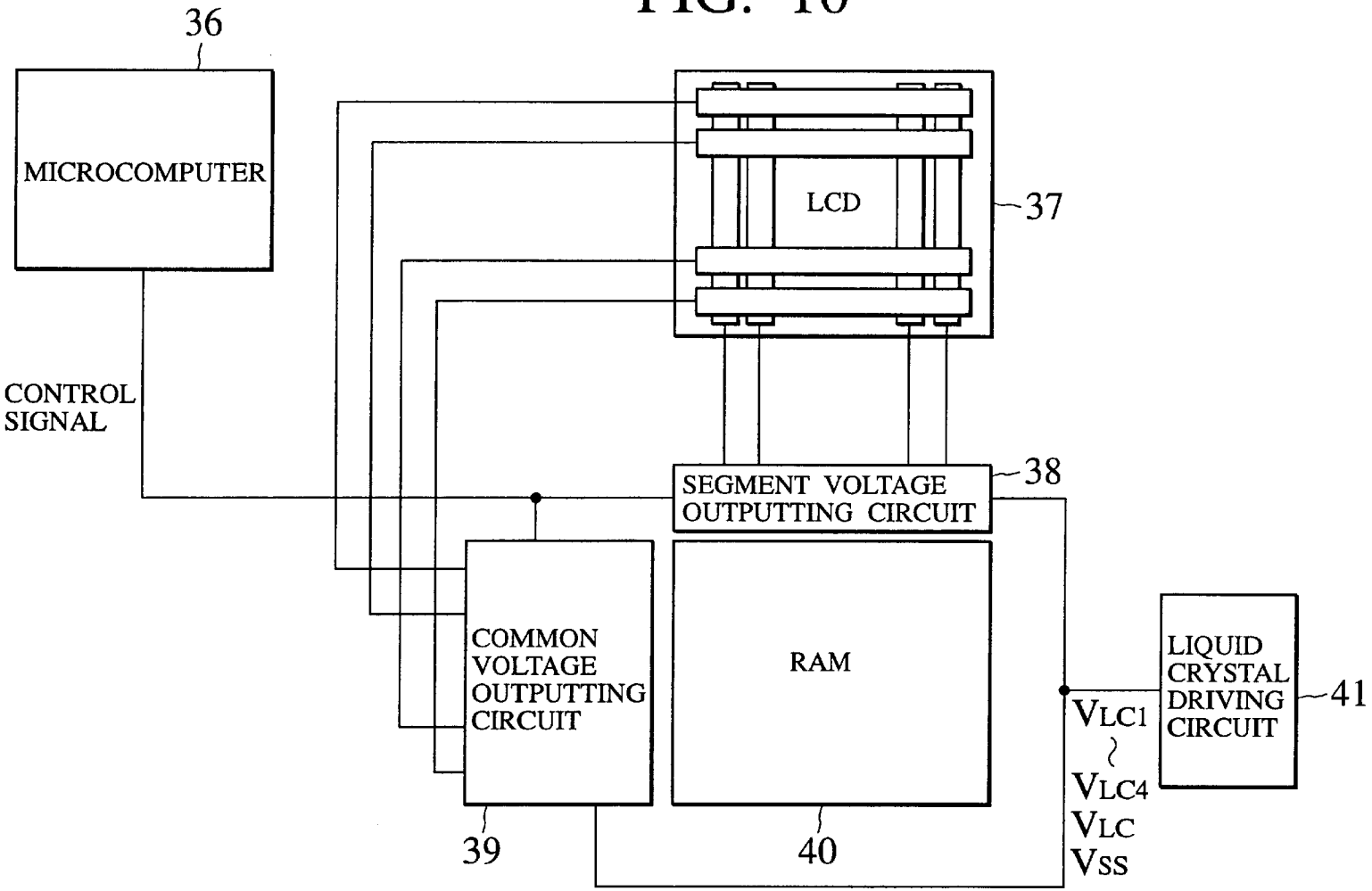
FIG. 10 is a block circuit diagram showing a configuration of a liquid crystal display device in which the liquid crystal driving circuit according to the embodiment of the present invention is installed.

FIG. 10 is a block circuit diagram showing a configuration of a liquid crystal display device in which the liquid crystal driving circuit according to the embodiment of the present invention is installed. As shown in FIG. 10, this liquid crystal display device comprises a microcomputer 36 for executing various controls, an LCD panel 37, a segment voltage outputting circuit 38, a common voltage outputting circuit 39, a RAM 40 for storing display data, and the liquid crystal driving circuit according to the embodiment of the present invention. In this liquid crystal display device, the segment voltage outputting circuit 38 and the common voltage outputting circuit 39 can output signals for displaying the display data stored in the RAM 40 on the LCD panel 37. When the segment voltage outputting circuit 38 and the common voltage outputting circuit 39 receive the liquid crystal driving intermediate potentials VLC1 to VLC4 generated by the liquid crystal driving circuit 41 and VLC, Vss and then outputs predetermined voltages sequentially to respective segment electrodes and respective common electrodes based on the control signal supplied from the microcomputer 36, this display operation is carried out.

As described above, the liquid crystal driving circuit according to the embodiment of the present invention comprises the charge pump capacitor, a plurality of charge storage capacitors being connected between a plurality of external terminals, a logic circuit for generating a plurality of time division signals, and a group of analogue switches for switching connection states of the charge pump capacitor and the plurality of charge storage capacitors based on the time division signals. The charges are supplied to the charge pump capacitor at the first timing. The ON/OFFs of the analogue switches are controlled selectively based on the time division signals at the succeeding timings to thus connect the charge pump capacitor in parallel with the desired charge storage capacitor. As a result, the charges in the charge pump capacitor can be supplied to the charge storage capacitors to thus generate the liquid crystal driving intermediate potential. In particular, each of the plurality of charge storage capacitors is composed of a plurality of capacitors which are connected between the terminals for generating the supplied voltage for the liquid crystal power supply and the plurality of external terminals, and a plurality of capacitors which are connected between the plurality of external terminals and the terminals for generating the reference voltage. In addition, the liquid crystal bias voltage is supplied to the charge pump capacitor. Such liquid crystal bias voltage is a difference between the output of the first regulator, which is connected between the terminal for generating the supply voltage and the terminal for generating the reference voltage, and the output of the second regulator, which is connected between the output of the first regulator and the reference voltage.

In this manner, according to the liquid crystal driving circuit according to the embodiment of the present invention, the power consumption can be reduced considerably by employing the charge pump system using the step up/down voltage of the capacitor. Furthermore, reduction in the power consumption can be achieved much more by employing the low power consumption regulator to charge the charge pump capacitor.

Various modifications will become possible for those skilled in the art after receiving the teachings of the present disclosure without departing from the scope thereof.

What is claimed is:

1. A liquid crystal driving circuit comprising:

(a) a first capacitor;

(b) a plurality of external terminals;

(c) a plurality of second capacitors connected between the plurality of external terminals;

(d) a first regulator connected between a first power supply and a second power supply;

(e) a second regulator connected between an output of the first regulator and the second power supply;

(f) a circuit for generating a plurality of time division signals; and (g) a switching means for connecting outputs of the first regulator and the second regulator to the first capacitor, or the first capacitor to any one of the second capacitors, based on the time division signals.

2. A liquid crystal driving circuit according to claim 1, wherein the first power supply is a power supply which supplies a liquid crystal power supply generating voltage, and the second power supply is a power supply which supplies a reference voltage.

3. A liquid crystal driving circuit according to claim 2, wherein the reference voltage is a ground voltage.

4. A liquid crystal driving circuit according to claim 3, wherein the first capacitor is charged by connecting one end of the first capacitor to an output of the first regulator and other end of the first capacitor to an output of the second regulator, and charges are supplied from the first capacitor to the plurality of second capacitors selectively by connecting the first capacitor in parallel with any one of the plurality of second capacitors.

5. A liquid crystal driving circuit according to claim 1, wherein the switching means is composed of a plurality of analogue switches.

6. A liquid crystal driving circuit according to claim 1, wherein the plurality of second capacitors is composed of a plurality of third capacitors which are connected between the first power supply and the plurality of external terminals, and a plurality of fourth capacitors which are connected between the plurality of external terminals and the second power supply.

* * * * *